US008543245B2

(12) United States Patent
Heitman et al.

(10) Patent No.: US 8,543,245 B2
(45) Date of Patent: Sep. 24, 2013

(54) SYSTEMS AND METHODS FOR SPECIFYING AN OPERATIONAL PARAMETER FOR A PUMPING SYSTEM

(75) Inventors: Chad Heitman, Duncan, OK (US); Stanley V. Stephenson, Duncan, OK (US); David W. Looper, Duncan, OK (US); Kenneth G. Neal, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 545 days.

(21) Appl. No.: 12/623,166

(22) Filed: Nov. 20, 2009

(65) Prior Publication Data

US 2011/0125332 A1 May 26, 2011

(51) Int. Cl.

| | |
|---|---|
| ***G05D 7/00*** | (2006.01) |
| ***G05D 16/00*** | (2006.01) |
| ***G06F 19/00*** | (2011.01) |
| ***G01F 17/00*** | (2006.01) |
| ***G01L 27/00*** | (2006.01) |
| ***G01L 7/00*** | (2006.01) |
| ***F04B 49/00*** | (2006.01) |
| ***F04B 49/06*** | (2006.01) |
| ***F16D 31/02*** | (2006.01) |
| *G05D 17/00* | (2006.01) |

(52) U.S. Cl.

USPC ..... 700/282; 60/411; 702/50; 702/51; 702/98; 702/138; 700/159; 700/170; 700/287; 700/288; 700/289; 700/290; 700/291; 700/301; 417/25; 417/44.4; 137/836

(58) Field of Classification Search

USPC ..... 60/411; 137/836; 700/282, 159, 700/170, 287–290, 301; 702/50–51, 98, 702/138; 417/25, 44.4

See application file for complete search history.

(56) References Cited

U.S. PATENT DOCUMENTS

| | | | | | |
|---|---|---|---|---|---|
| 2,385,112 | A | * | 9/1945 | Smith et al. | 123/525 |
| 3,662,276 | A | * | 5/1972 | Hyer | 330/1 A |
| 3,812,855 | A | * | 5/1974 | Banko | 604/31 |
| 3,827,828 | A | * | 8/1974 | Edwards | 417/43 |
| 3,905,501 | A | * | 9/1975 | Leroux | 414/699 |
| 3,921,435 | A | * | 11/1975 | Howard | 374/5 |
| 3,949,734 | A | * | 4/1976 | Edwards et al. | 600/16 |
| 4,024,866 | A | * | 5/1977 | Wallach | 604/31 |
| 4,059,745 | A | * | 11/1977 | Gaertner | 700/33 |
| 4,120,033 | A | * | 10/1978 | Corso et al. | 702/47 |
| 4,160,627 | A | | 7/1979 | Cole | |
| 4,226,590 | A | * | 10/1980 | Hofmann | 433/28 |
| 4,289,158 | A | * | 9/1981 | Nehring | 137/205 |
| 4,290,448 | A | * | 9/1981 | Budzich | 137/596.13 |

(Continued)

FOREIGN PATENT DOCUMENTS

JP 62087688 A * 4/1987

*Primary Examiner* — Kavita Padmanabhan
*Assistant Examiner* — Thomas Stevens
(74) *Attorney, Agent, or Firm* — John W. Wustenberg; Baker Botts L.L.P.

(57) ABSTRACT

Systems and methods for specifying one or more operational parameters for a pumping system are disclosed. A first suction pressure loss profile for a first pump in a pumping system is determined. A second suction pressure loss profile for a second pump in the pumping system is determined. The first suction pressure loss profile is compared with the second suction pressure loss profile. One or more operational parameters are specified based, at least in part, on the comparison.

19 Claims, 14 Drawing Sheets

(56) References Cited

U.S. PATENT DOCUMENTS

| | | | | | |
|---|---|---|---|---|---|
| 4,301,880 | A | * | 11/1981 | Krambrock et al. | 177/189 |
| 4,314,668 | A | * | 2/1982 | Jansen et al. | 237/2 B |
| 4,325,223 | A | * | 4/1982 | Cantley | 62/126 |
| 4,380,877 | A | * | 4/1983 | Poux | 34/225 |
| 4,384,462 | A | * | 5/1983 | Overman et al. | 62/175 |
| 4,417,857 | A | * | 11/1983 | Sudbeck | 417/490 |
| 4,424,709 | A | | 1/1984 | Meier, Jr. et al. | |
| 4,432,064 | A | | 2/1984 | Barker et al. | |
| 4,435,193 | A | * | 3/1984 | Gullichsen et al. | 95/19 |
| 4,451,893 | A | * | 5/1984 | Izumi et al. | 700/282 |
| 4,527,954 | A | | 7/1985 | Murali et al. | |
| 4,535,602 | A | * | 8/1985 | Alsenz et al. | 62/175 |
| 4,537,038 | A | * | 8/1985 | Alsenz et al. | 62/118 |
| 4,559,610 | A | * | 12/1985 | Sparks et al. | 703/9 |
| 4,562,531 | A | * | 12/1985 | Enterline et al. | 700/44 |
| 4,597,718 | A | * | 7/1986 | Nakano et al. | 417/300 |
| 4,612,776 | A | * | 9/1986 | Alsenz | 62/175 |
| 4,705,459 | A | | 11/1987 | Buisine et al. | |
| 4,762,467 | A | * | 8/1988 | Ackermann et al. | 417/54 |
| 4,806,082 | A | * | 2/1989 | Schenk | 417/388 |
| 4,813,858 | A | * | 3/1989 | Eisenbacher | 418/61.2 |
| 4,904,158 | A | * | 2/1990 | Kun | 416/183 |
| 4,934,399 | A | * | 6/1990 | Cho | 137/14 |
| 5,063,598 | A | * | 11/1991 | Geddes | 381/71.5 |
| 5,113,894 | A | * | 5/1992 | Yoshida | 137/106 |
| 5,186,277 | A | * | 2/1993 | Snuttjer et al. | 184/6.22 |
| 5,213,477 | A | * | 5/1993 | Watanabe et al. | 417/20 |
| 5,215,253 | A | * | 6/1993 | Saidman et al. | 239/61 |
| 5,277,483 | A | * | 1/1994 | Yosida et al. | 303/113.2 |
| 5,351,726 | A | * | 10/1994 | Diggins | 141/4 |
| 5,360,139 | A | * | 11/1994 | Goode | 222/40 |
| 5,513,732 | A | * | 5/1996 | Goates | 192/3.3 |
| 5,586,973 | A | * | 12/1996 | Lemaire et al. | 604/19 |
| 5,615,996 | A | * | 4/1997 | Suzuki et al. | 415/1 |
| 5,630,799 | A | * | 5/1997 | Beiser et al. | 604/66 |
| 5,646,341 | A | * | 7/1997 | Schricker et al. | 73/114.57 |
| 5,680,329 | A | * | 10/1997 | Lloyd et al. | 700/275 |
| 5,720,598 | A | * | 2/1998 | de Chizzelle | 417/53 |
| 5,752,785 | A | * | 5/1998 | Tanaka et al. | 405/52 |
| 5,772,403 | A | * | 6/1998 | Allison et al. | 417/44.2 |
| 5,940,290 | A | * | 8/1999 | Dixon | 700/9 |
| 6,178,393 | B1 | * | 1/2001 | Irvin | 703/10 |
| 6,260,004 | B1 | * | 7/2001 | Hays et al. | 702/183 |
| 6,273,076 | B1 | * | 8/2001 | Beck et al. | 123/679 |
| 6,330,525 | B1 | * | 12/2001 | Hays et al. | 702/183 |
| 6,422,009 | B1 | * | 7/2002 | Nozawa et al. | 60/447 |
| 6,487,903 | B2 | * | 12/2002 | Sabini et al. | 73/168 |
| 6,505,691 | B2 | * | 1/2003 | Judge et al. | 175/70 |
| 6,701,223 | B1 | * | 3/2004 | Rachford et al. | 700/301 |
| 6,709,241 | B2 | * | 3/2004 | Sabini et al. | 417/53 |
| 6,735,942 | B2 | * | 5/2004 | Wild et al. | 60/397 |
| 6,807,501 | B1 | * | 10/2004 | Hyde | 702/114 |
| 6,859,740 | B2 | * | 2/2005 | Stephenson et al. | 702/35 |
| 6,954,713 | B2 | * | 10/2005 | Eryurek | 702/140 |
| 7,013,223 | B1 | | 3/2006 | Zhang et al. | |
| 7,353,875 | B2 | | 4/2008 | Stephenson et al. | |
| 7,494,590 | B2 | * | 2/2009 | Felding et al. | 210/646 |
| 7,623,986 | B2 | * | 11/2009 | Miller | 702/182 |
| 8,006,507 | B2 | * | 8/2011 | Bittner | 62/178 |
| 2002/0123856 | A1 | * | 9/2002 | Eryurek | 702/140 |
| 2003/0128251 | A1 | * | 7/2003 | Ujita | 347/29 |
| 2004/0112115 | A1 | * | 6/2004 | Ramamoorthy et al. | 73/1.01 |
| 2009/0044401 | A1 | * | 2/2009 | Maenishi | 29/740 |
| 2010/0300683 | A1 | * | 12/2010 | Looper et al. | 166/250.01 |
| 2011/0038746 | A1 | * | 2/2011 | Eisenmann | 418/166 |
| 2011/0070103 | A1 | * | 3/2011 | Allidieres | 417/53 |

* cited by examiner

PRIOR ART

PRIOR ART

SYSTEMS AND METHODS FOR SPECIFYING AN OPERATIONAL PARAMETER FOR A PUMPING SYSTEM

BACKGROUND

The present disclosure relates to pumps of the multiplex type, and, more particularly, to systems and methods for specifying an operational parameter for a pumping system.

In the oil industry, multiplex pumps may be utilized to deliver pumped fluid for oilfield operations. Multiplex pumps may be positive displacement pumps, such as plunger pumps, with a plurality of chambers and may be triplex, quintuplex or another type of multiplex pump. FIG. 1A (Prior Art) shows a top view of an example triplex pump 100 with three chambers 110A-C. FIG. 1B (Prior Art) shows a partial cross-sectional side view of pump 1100. Fluid may enter pump 100 through suction header inlet 120, be displaced by operation of plunger 130 and discharge through discharge outlet 140.

Multiplex pumps may be used in various applications such as well stimulation operations. In some cases, multiplex pumps may be mounted on vehicles and brought to a well site for use in a pumping system. A pumping system may include several multiplex pumps combined to produce a suitable volume of fluid at a suitable rate and pressure. Pumping systems may be subject to limitations such as limited supply of pressure on the suction side of the pumps. A sufficient supply of suction side pressure may be particularly important in avoiding cavitation, which is a well-known problem in the field.

SUMMARY

The present disclosure relates to pumps of the multiplex type, and, more particularly, to systems and methods for specifying an operational parameter for a pumping system.

In one aspect, a method of specifying one or more operational parameters for a pumping system is disclosed. A first suction pressure loss profile for a first pump in a pumping system is determined. A second suction pressure loss profile for a second pump in the pumping system is determined. The first suction pressure loss profile is compared with the second suction pressure loss profile. One or more operational parameters are specified based, at least in part, on the comparison.

In another aspect, a computer program, stored in a tangible medium specifying one or more operational parameters for a pumping system, is disclosed. The computer program includes executable instructions to cause at least one processor to: determine a first suction pressure loss profile for a first pump in a pumping system; determine a second suction pressure loss profile for a second pump in the pumping system; compare the first suction pressure loss profile with the second suction pressure loss profile; and specify one or more operational parameters based, at least in part, on the comparison.

In another aspect, an information handling system is disclosed. A processor is communicatively coupled to a memory. A computer readable medium includes instructions that cause the at least one processor to: determine a first suction pressure loss profile for a first pump in a pumping system; determine a second suction pressure loss profile for a second pump in the pumping system; compare the first suction pressure loss profile with the second suction pressure loss profile; and specify one or more operational parameters based, at least in part, on the comparison.

The features and advantages of the present disclosure will be readily apparent to those skilled in the art. While numerous changes may be made by those skilled in the art, such changes are within the spirit of the invention.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features.

DESCRIPTION OF PREFERRED EMBODIMENTS

The present disclosure relates to pumps of the multiplex type, and, more particularly, to systems and methods for specifying an operational parameter for a pumping system. Stated otherwise, the systems and methods of the present disclosure may allow suction characteristics of multiplex pumps in a pumping system to be improved and the possibility of cavitation in those pumps to be reduced. Certain embodiments of this disclosure may be employed prior to operation, for example, as a planning tool. Certain embodiments may be employed during operation, for example, to adjust and optimize multiplex pumps and pump configurations in a pumping system.

Illustrative embodiments of the present disclosure are described in detail herein. In the interest of clarity, not all features of an actual implementation are described in this specification. It will of course be appreciated that in the development of any such actual embodiment, numerous implementation-specific decisions must be made to achieve developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

Figure 1A:
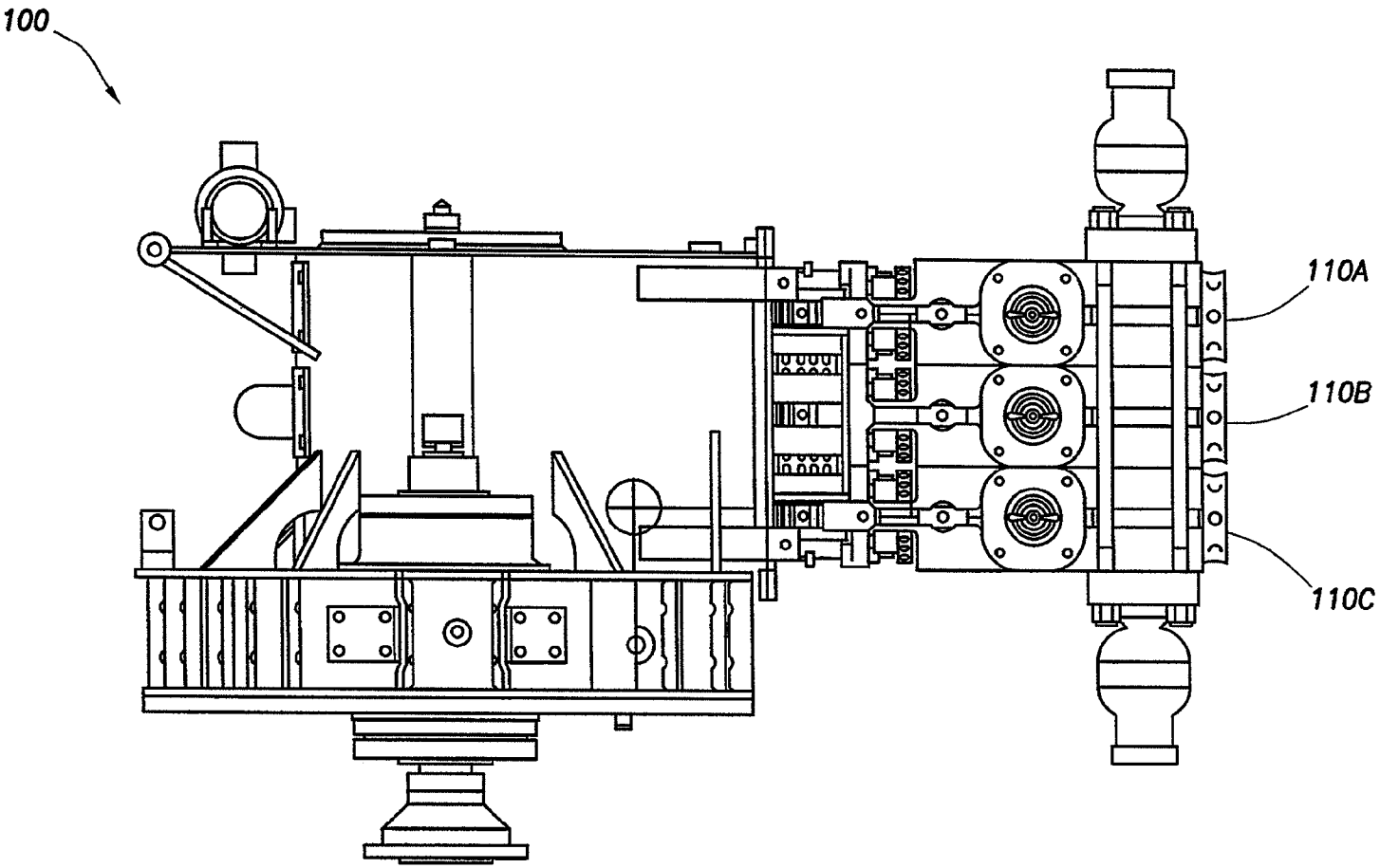
FIG. 1A illustrates a top view of one example triplex pump that may be used in accordance with certain embodiments of the present disclosure.
Figure 1B:
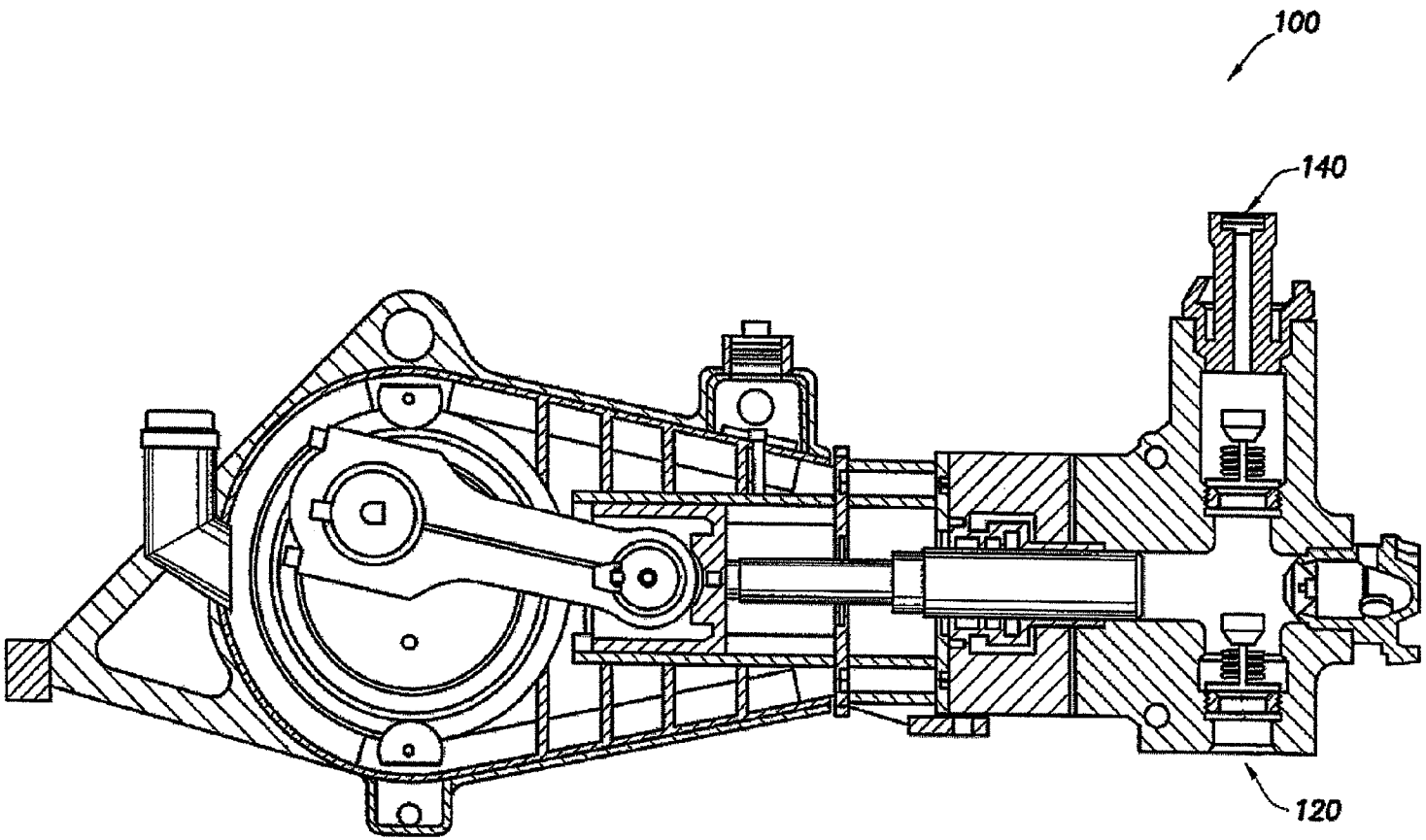
FIG. 1B illustrates a partial cross-sectional side view of one example triplex pump that may be used in accordance with certain embodiments of the present disclosure.
Figure 2:
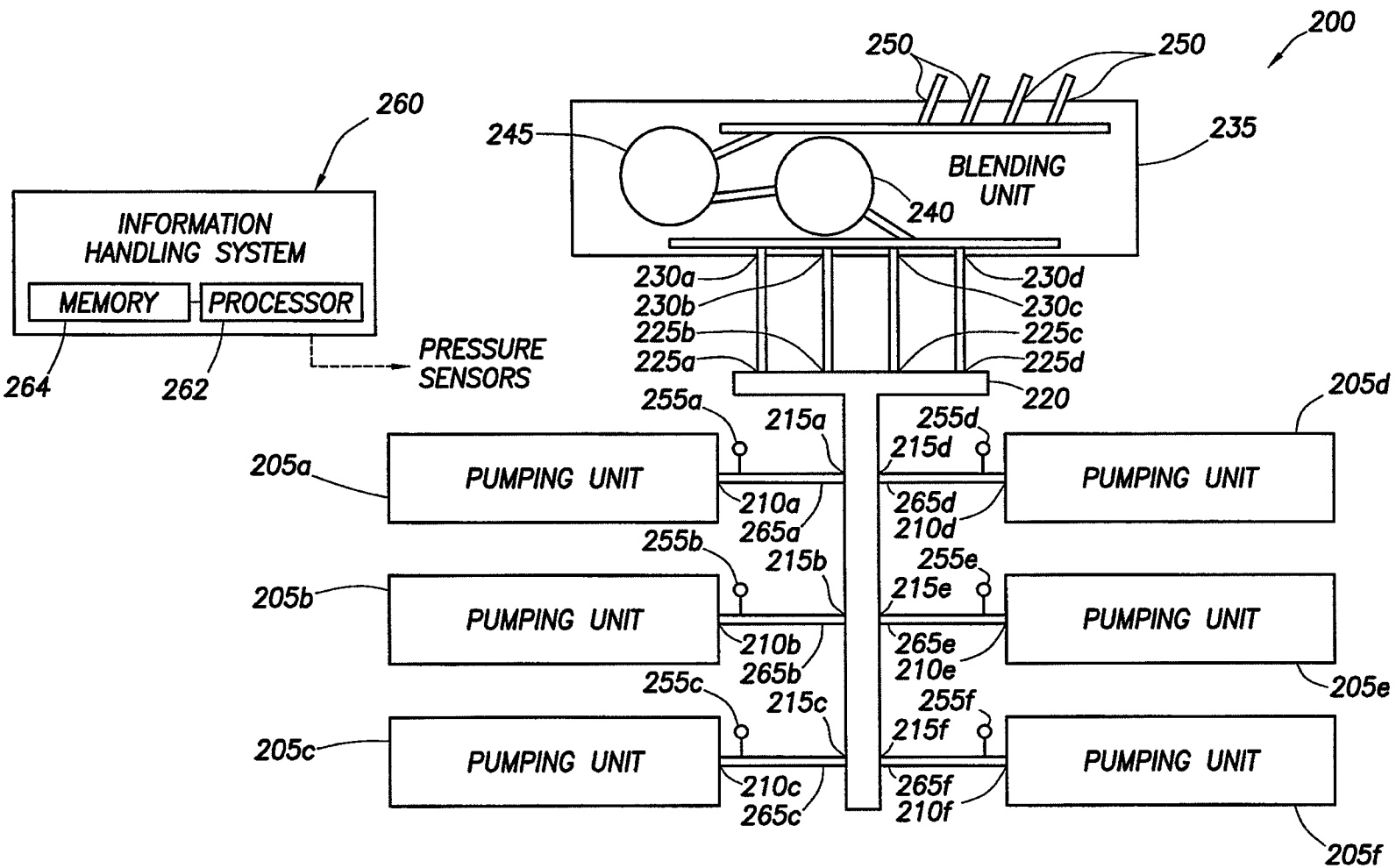
FIG. 2 illustrates a block diagram of one example pumping system in accordance with certain embodiments of the present disclosure.

FIG. 2 illustrates a block diagram of one example pumping system 200 in accordance with certain embodiments of the present disclosure. One or more pumping units 205 may be employed to displace one or more volumes of fluid for an oilfield operation. As depicted, pumping system 200 may include six pumping units 205*a-f* (collectively, pumping units 205) for fracturing operations. Pumping units 205 may include positive displacement pumps, such as plunger pumps, or another type of pump, as would be understood by one of ordinary skill in the art. In certain embodiments, pumping units 205 may be of a multiplex type, such as triplex, quintuplex, or another type of multiplex pump. Although six pumping units are illustrated in FIG. 2, it should be understood that a different number of pumping units may be utilized, as desired for various pumping situations. Over the course of an operation, the number of pumping units in service may be changed depending on the specifics of the operation as, for example, when a pumping unit is brought off-line.

Pumping units 205*a-f* may each discharge through a discharge line (not shown) via individual pump outlets and discharge lines (not shown). Pumping units 205*a-f* may receive fluid via pump header inlets 210*a-f*, respectively. Pump header inlets 210*a-f* may be respectively coupled via suction lines 265*a-f* to manifold outlets 215*a-f* of manifold 220. Suction lines 265*a-f* may include a hose, a pipe and/or another type of connection line or conduit. Manifold 220 may be deployed on a mobile manifold trailer (not shown). One or more manifold inlets 225 (illustrated as 225*a-d* in FIG. 2) may be configured to receive fluid and may be coupled to one or more blending unit outlets 230 (illustrated as 230*a-d* in FIG. 2) of blending unit 235. Blending unit 235 may include a boost pump 240, a mixing tub 245, and one or more inlets 250 configured to receive fluid from one or more fluid supply sources.

Pressure sensors 255*a-f* (collectively, pressure sensors 255) may be disposed to sense fluid pressure at or in the proximity of pump header inlets 210*a-f*. Although not shown in FIG. 2, additional pressure sensors may be disposed to sense fluid pressure at various locations. For example, pressure sensors may be disposed to sense fluid pressure at or in the proximity of one or more of the intake and outlet of boost pump 240, blending unit outlets 230, manifold inlets 225, and manifold outlets 215*a-f*. Pressure sensors 255 may be pressure transducers or other types of pressure-sensing devices adapted for use as pressure sensors. As will be apparent to one skilled in the art, pressure sensors 255 may be capable of sensing pressure at any suitable frequency considering the pressure characteristics of a given pumping system. For example, the pressure sensors 255 may sense pressure and produce corresponding signals suitable for real-time monitoring of pressure oscillations such as those illustrated in FIGS. 4 and 6 (discussed further herein).

Referring again to FIG. 2, in one exemplary embodiment, pressure sensors 255*a-f* and one or more of the above-noted additional pressure sensors may be communicatively coupled to an information handling system 260. Information handling system may include a processor 262 communicatively coupled to a memory 264. For purposes of this disclosure, information handling system 260 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, information handling system 260 may be a personal computer, a network storage device, or any other suitable device and may vary in size, shape, performance, functionality, and price. Information handling system 260 may include random access memory (RAM), one or more processing resources such as a central processing unit (CPU) or hardware or software control logic, ROM, and/or other types of nonvolatile memory. Additional components of information handling system 260 may include one or more disk drives, one or more network ports for communication with external devices as well as various input and output (I/O) devices, such as a keyboard, a mouse, and a video display. Information handling system 260 may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory; as well as communications media such wires, optical fibers, microwaves, radio waves, and other electromagnetic and/or optical carriers; and/or any combination of the foregoing.

As would be appreciated by those of ordinary skill in the art, with the benefit of this disclosure, the pressure sensors 255 may be coupled to information handling system 260 through wired and/or wireless connections. For the sake of clarity, complete connections are not depicted in FIG. 2. Information handling system 260 may display and process pressure sensor readings.

A change in inertia pressure loss or inertance in a hose, pipe or another type of line may be indicated by:

$$\Delta P = \frac{dQ}{dt}\frac{\rho L}{A}$$

In this equation, ΔP may represent an absolute value of inertia pressure loss; Q may represent fluid flowrate, ρ may represent fluid density; L may represent a length of a line, such as a hose or pipe; and A may represent a cross-sectional area of the line. Accordingly, inertia pressure loss may increase with increasing flowrate, increasing fluid density, increasing line length and/or decreasing line area. This equation, as well as simulation and test data, indicate that inertia pressure loss in a pumping system may be significantly larger than frictional pressure loss and, further, that a suction line has a significant effect on pump suction pressure.

Figure 3:
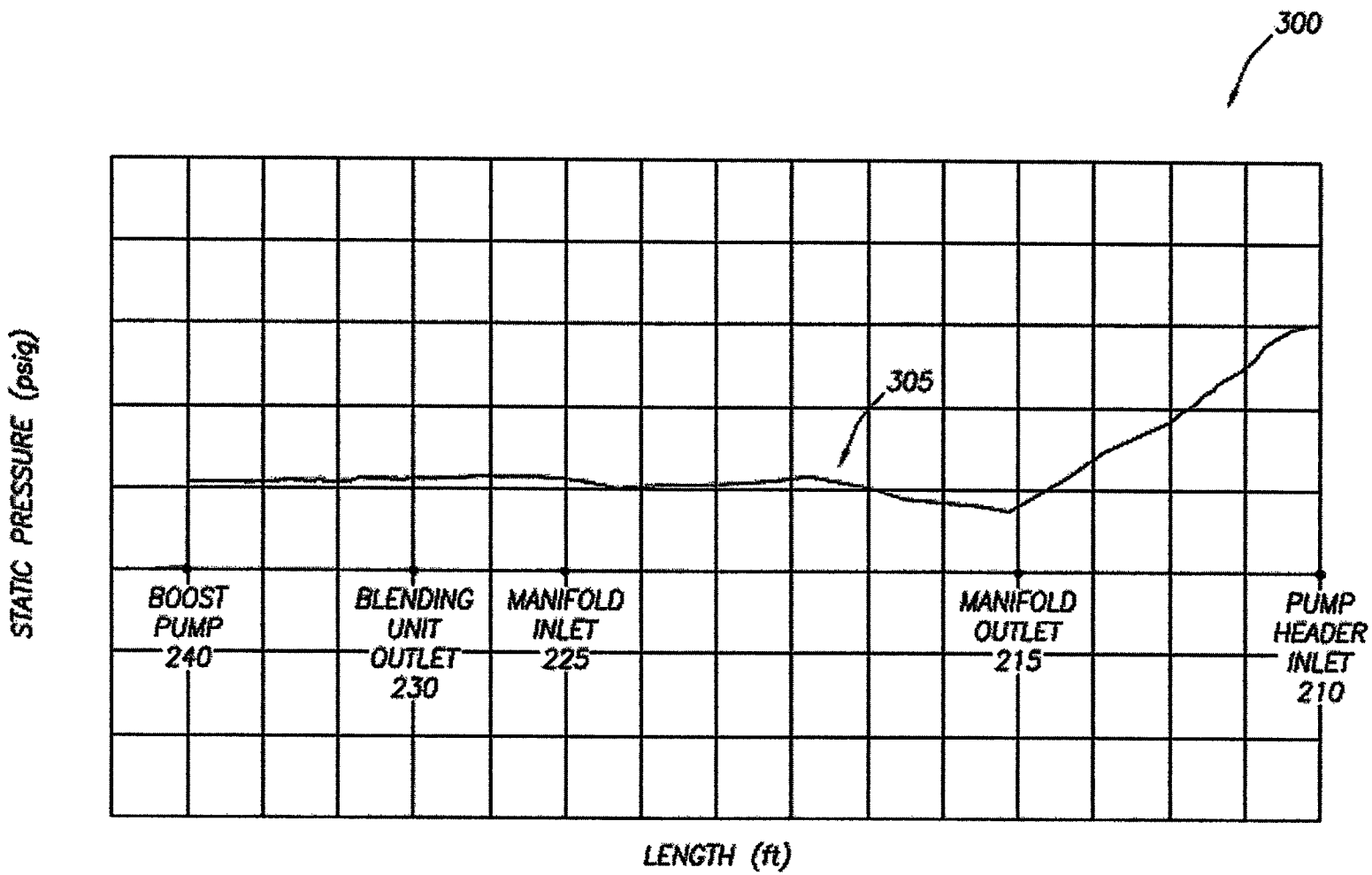
FIG. 3 illustrates a graph of exemplary data for one example pumping system in accordance with certain embodiments of the present disclosure.

FIG. 3 shows a graph 300 of exemplary data for a pumping system. Graph 300 illustrates an inertia pressure profile from a boost pump to a pump suction header at a time t1, for a system such as that shown in FIG. 2. The vertical axis represents inertia pressure of the fluid in pounds per pounds-force per square inch gauge (psig); the horizontal axis represents the length of the fluid path in feet. Line 305 illustrates the different inertia pressure readings at a time t1 for various points in the system. As indicated on FIG. 3, certain points along the horizontal axis correspond to system locations of boost pump 240, blending unit outlet 230, manifold inlet 225, manifold outlet 215, and pump header inlet 210.

Figure 4:
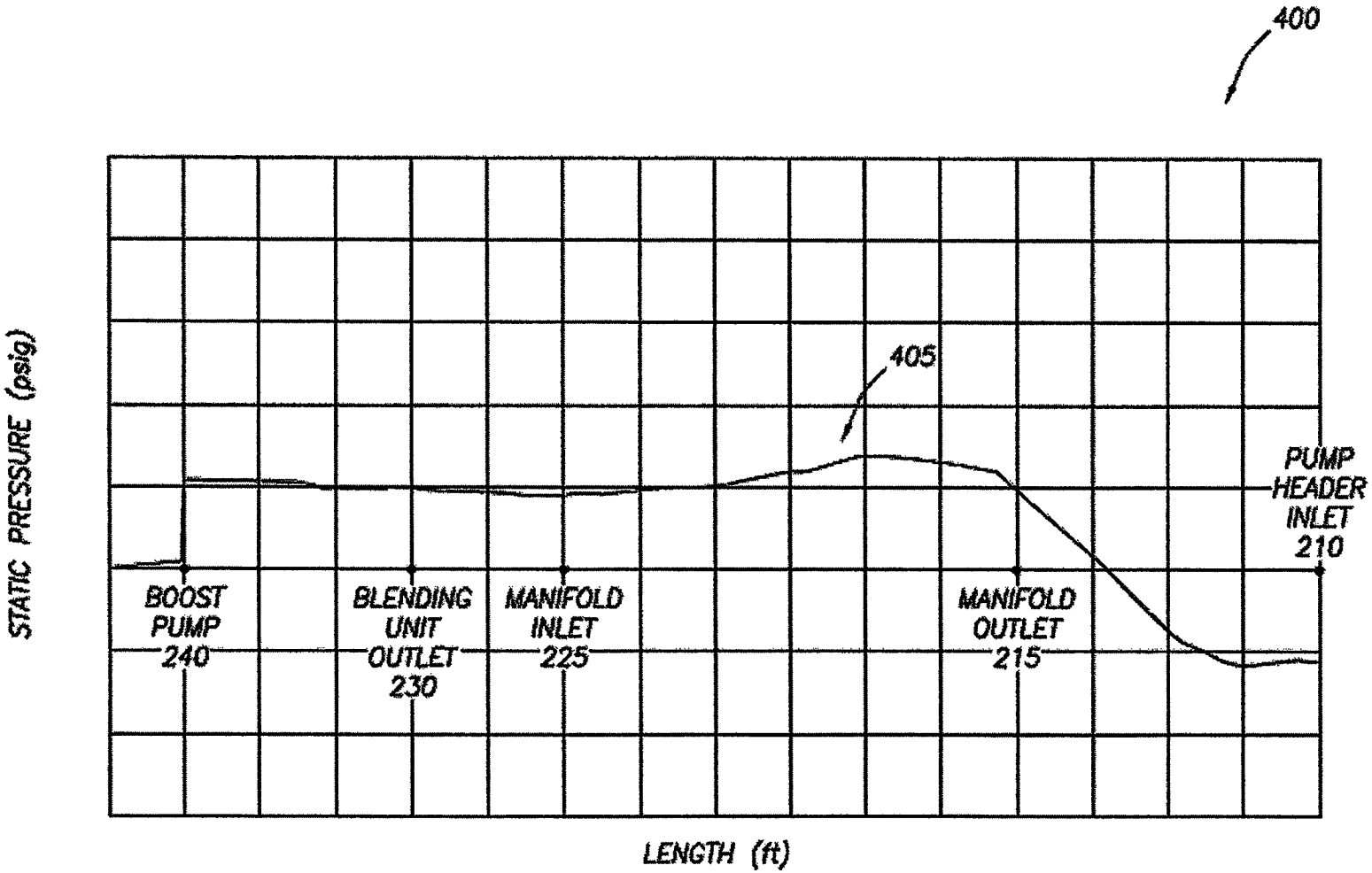
FIG. 4 illustrates a graph of exemplary data for one example pumping system in accordance with certain embodiments of the present disclosure.

FIG. 4 shows a graph 400 of exemplary data for the pumping system at a time t2. As illustrated by inertia pressure profile 405, the greatest inertia pressure loss occurs near pump header inlet 210. A comparison of FIGS. 3 and 4 reveals that, from t1 to t2, significant changes occur between manifold outlet 215 and pump header inlet 210, which corresponds to a suction line 265 in the pumping system.

Taken together, FIGS. 3 and 4 show the inertia pressure profiles 305, 405 to be relatively steady over most of pumping system 200's length, with the greatest pressure changes generally occurring near the pump header. Fluid viscosity may be a cause of a pressure drop on the suction side of high-pressure pumps. However, testing and modeling show that inertia pressure loss in a pumping system may be much larger than frictional pressure loss, and that pressure oscillations in the connection between a manifold and a pumping unit may be significantly affected by suction line length.

Figure 5:
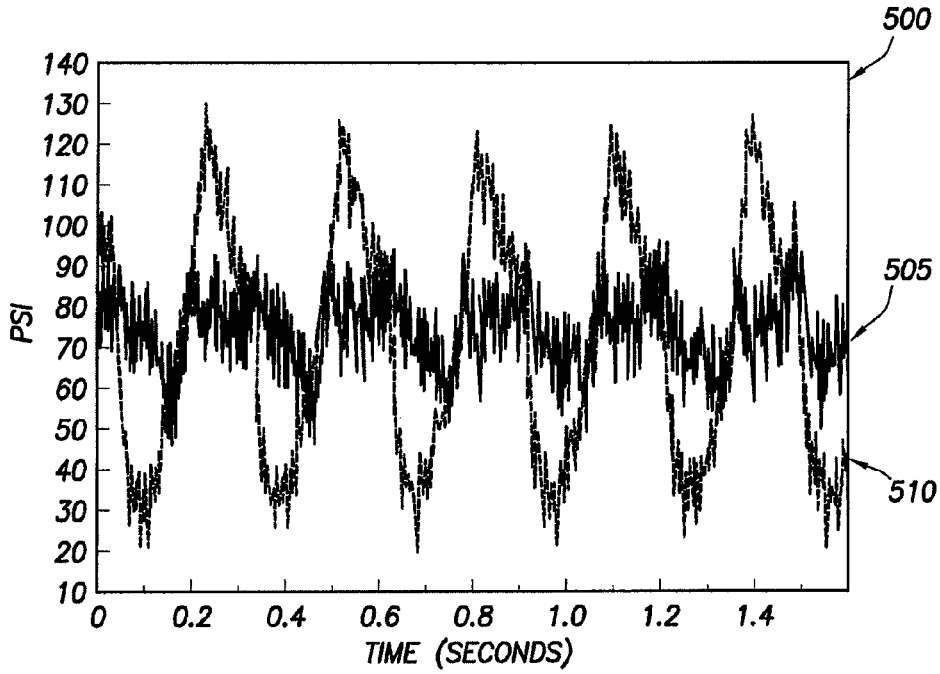
FIG. 5 illustrates a graph of exemplary data for one example pumping system in accordance with certain embodiments of the present disclosure.

FIG. 5 shows a graph 500 of exemplary data for suction pressure profiles corresponding to two points in pumping system 200. The data shown in this example corresponds to a pumping unit 205 in FIG. 2 with 5-inch fluid ends, running at 5.5 bpm, and connected to manifold outlet 215 via a 40-foot suction line 265. The vertical axis represents inertia pressure loss of the fluid in pounds per square inch (psi) the horizontal axis represents a duration of pump operation in seconds. Suction pressure profile 505 represents the suction pressure at manifold outlet 215. Suction pressure profile 510 represents the suction pressure at pump header inlet 210. Each suction pressure profile oscillates with time. The oscillations of suction pressure profile 510 may be distinguished from the oscillations of suction pressure profile 505 by the greater amplitudes of profile 510.

Figure 6:
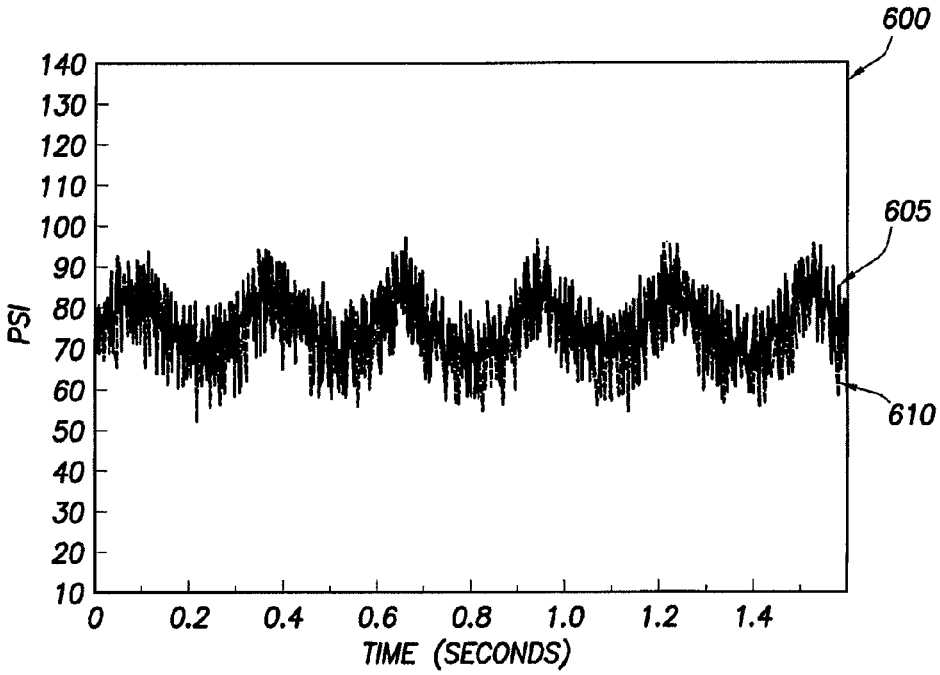
FIG. 6 illustrates a graph of exemplary data for one example pumping system in accordance with certain embodiments of the present disclosure.

FIG. 6 shows a graph 600 of exemplary data for suction pressure profiles corresponding to FIG. 5, except FIG. 6 illustrates pressure readings for a system with a 10-foot suction line 265. The oscillations of suction pressure profile 610 for pump header inlet 210 are relatively close to the oscillations of suction pressure profile 605 for manifold outlet 215. A comparison of FIGS. 5 and 6 reveals that the length of a suction line 265 connecting pumping unit 205 with manifold 220 may have a significant effect on pump suction pressures. The pumping unit corresponding to FIG. 5 with a longer suction line 265 exhibits larger oscillations in pressure, while the pumping unit corresponding to FIG. 6 with a shorter suction line 265 exhibits smaller oscillations in pressure.

In certain embodiments of this disclosure, optimal pump rates and/or configurations may be planned before commencement of an oilfield operation. An information handling system may utilize a simulation tool for analysis of suction pressure loss profiles, thereby facilitating planning of a pumping system 200 to minimize swings in pressure. In that way, the mean boost pressure required to prevent cavitation may be reduced, and boost to the pumps may be maximized in an efficient manner. A proposed pumping system 200 may be modeled with a simulation tool to determine the suction pressure loss profiles for proposed pumps in the pumping system. The simulation tool may be used to specify one or more operational parameters of the pumping system that, by way of example without limitation, may include pump flow rates (obtained by varying engine speed and transmission gear), suction pressures, pump types, pump sizes, pump ratings, pumping system configurations, suction line lengths, modes of operation, and redundancy. In a typical well operation, the pump discharge pressure is dictated by the rate in the well. Therefore, the pump rate is maintained by increasing the rate of one pump anytime another must be slowed down to reduce the inertia pressure loss for a particular multiplex pump. A person of ordinary skill in the art having the benefit of this disclosure would understand that various configurations may be optimized in various ways depending on the specifics of a particular implementation.

Figure 8:
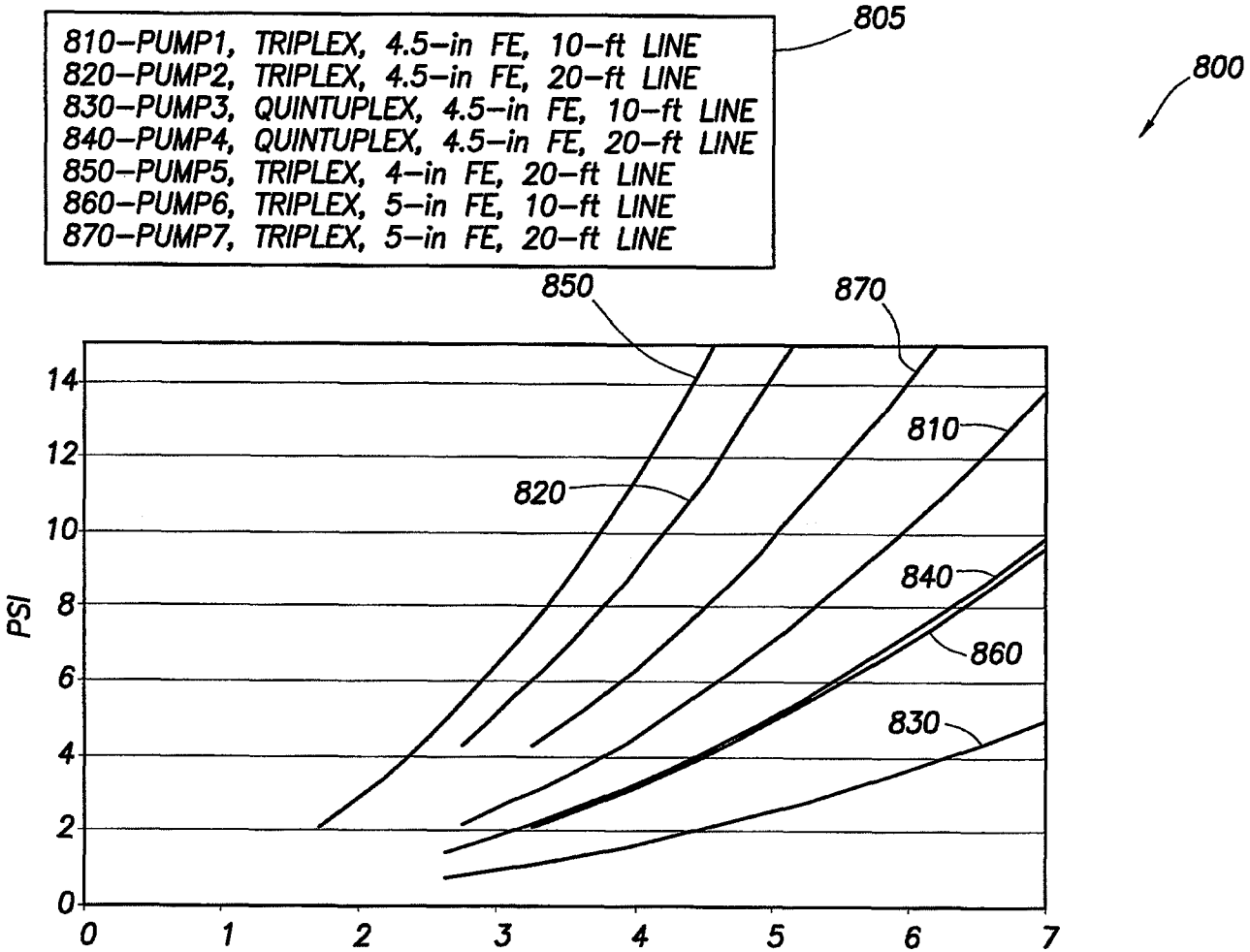
FIG. 8 illustrates a graph of exemplary data for one example pumping system in accordance with certain embodiments of the present disclosure.

FIG. 8 shows a graph 800 of exemplary data for pump suction pressure in suction lines plotted against pump rates of several pumping units. The vertical axis represents inertia pressure loss of the fluid in psi across a suction line. The horizontal axis represents pump rates in barrels per minute (bpm). Element 805 is the legend for the graphical depictions. Each of curves 810-870 may correspond to a suction pressure loss profile for a pumping unit in a pumping system similar to pumping system 200. Curve 810 may correspond to a 4.5-inch fluid end (FE) triplex pumping unit connected to a manifold with a 10-foot suction line. Curve 820 may correspond to a 4.5-inch FE, triplex pumping unit connected with a 20-foot suction line. Curve 830 may correspond to a 4.5-inch FE quintuplex pumping unit connected with a 10-foot suction line. Curve 840 may correspond to a 4.5-inch FE quintuplex pumping unit connected with a 20-foot suction line. Curve 850 may correspond to a 4-inch FE triplex pumping unit connected with a 20-foot suction line. Curve 860 may correspond to a 5-inch FE, triplex pumping unit connected with a 10-foot suction line. Curve 870 may correspond to a 5-inch FE, triplex pumping unit connected with a 20-foot suction line. Thus, the exemplary data illustrated in graph 800 may correspond to a pumping system with seven pumping units of varying configurations. It should be understood that alternative configurations—e.g., with the same or different quantities and/or types of pumping units—may be desirable given the specifics of a particular oil field operation.

Suction pressure loss profiles, such as those illustrated in FIG. 8, may be used to balance pump rates and to ensure that all pumping units have optimal suction pressures. Pumps with higher pressure losses indicate a need to decrease pumping rates, whereas pumps with lower suction pressure losses indicate the capacity to increase pumping rates. For example, graph 800 may correspond to a pumping system in operation when Pumps 1-7 may operate with suction pressure loss profiles such as curves 810-870. It may be desirable to operate Pump 5 at a lower rate so that suction pressure loss may be minimized, which would correspond to an operating point tending toward the lower end of curve 850. Curve 850 indicates that operating Pump 5 at 2 bpm relates to an inertia pressure loss of approximately 3 psi, whereas an increase to 5 bpm relates to a loss near 12 psi. Hence, curve 850 indicates that relatively small increases in pumping rate may result in relatively substantial inertia pressure losses at the pump header inlet for Pump 5.

In contrast to curve 850, curve 830 indicates that Pump 3 may exhibit the approximate converse: a relatively small increase in inertia pressure loss for a relatively large increase in pumping rate. Curve 830 indicates that operating Pump 3 at 3 bpm relates to a loss of approximately 1 psi, whereas an increase to 7 bpm relates to a loss near 5 psi. Comparison of curve 830 with the other curves reveals that Pump 3 may operate at greater rates while incurring lesser inertia pressure losses relative to the other pumps.

Accordingly, in an example situation where one or more of the other pumps are taken out of operation, increasing the rate of Pump 5 may substantially increase pressure losses. This may necessitate more boost pressure from one or more boost pumps to raise the mean pressure sufficiently so that the pressure oscillations do not approach zero and cause cavitation. However, increasing boost pressure may not always be an option in specific cases, where a supply of boost pressure may be subject to limitations. For example, limitations on increasing a supply of boost pressure may include particular boost pump ratings and/or the ratings of the multiplex pumps in the pumping system. Operating certain multiplex pumps at high pump rates also may accelerate wear and erosion of the pump, thereby creating a potential for system failure. Accordingly, it may be desirable to increase the rate of Pump 3 to compensate at least in part, rather than increasing the rate of Pump 5, for example. This may be a more efficient means of maximizing boost to the pumps.

In certain embodiments of this disclosure, pump rates may be optimized during an operation when changes in pump rate are needed. For instance, in one exemplary embodiment, information handling system 260 may be used to monitor pump rates over time. Information handling system may optionally alert an operator when a pumping unit reaches a threshold level. The operator may designate a desired sampling interval at which the information handling system 260 may take readings of various pressure sensors. Information handling system 260 may then compare the pressure sensor readings to the threshold value to determine if the threshold value is reached. If the threshold value is reached, the information handling system 260 may alert the operator.

In certain embodiments, the information handling system 260 may provide a real-time visual depiction of one or more suction pressure profiles. A real-time display may automatically show the calculated inertia pressure drop for each pump. The pump rates may be adjusted to minimize the inertia pressure drop at each pump while still delivering the desired job rate. Balancing the pumping units may be an automated process. For example, a pumping unit with a lowest loss and slope in its suction pressure loss profile may be automatically adjusted when another pumping unit is to be slowed down or brought off-line. By balancing the pumping units in a pumping system, suction pressure requirements and the potential for cavitation may be minimized, which may lead to longer pump life.

Figure 7:
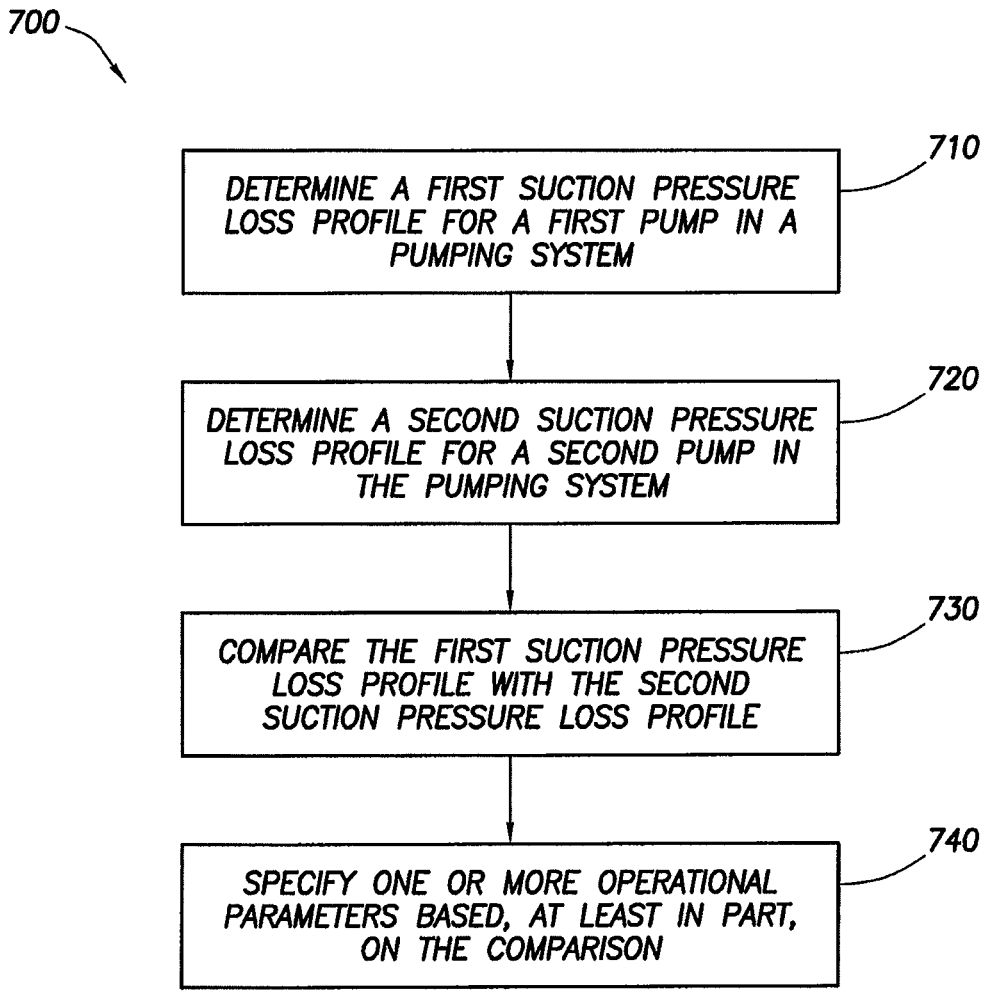
FIG. 7 is a flowchart showing one example method of specifying one or more operational parameters for a pumping system in accordance with certain embodiments of the present disclosure.

FIG. 7 is a flowchart showing one example method 700 of specifying one or more operational parameters for a pumping system in accordance with certain embodiments of the present disclosure. In step 710, a first suction pressure loss profile for a first pump may be determined. In step 720, a second suction pressure loss profile for a second pump may be determined. In step 730, the first suction pressure loss profile may be compared with the second suction pressure loss profile. In step 740, one or more operational parameters may be specified based, at least in part, on the comparison.

Although only two pumps are included in example method 700, it should be understood that method 700 may be used or adapted for use in a pumping system with more than two pumps. In certain embodiments, method 700 may be performed as a planning process to design, develop, evaluate, analyze and/or simulate a proposed pumping system. In certain embodiments, method 700 may be performed manually to evaluate, analyze, operate, adjust, balance and/or simulate an operational pumping system implemented at a work site. In certain embodiments, method 700 may be performed automatically to evaluate, analyze, operate, adjust, balance and/or simulate an operational pumping system implemented at a work site.

Figure 9:
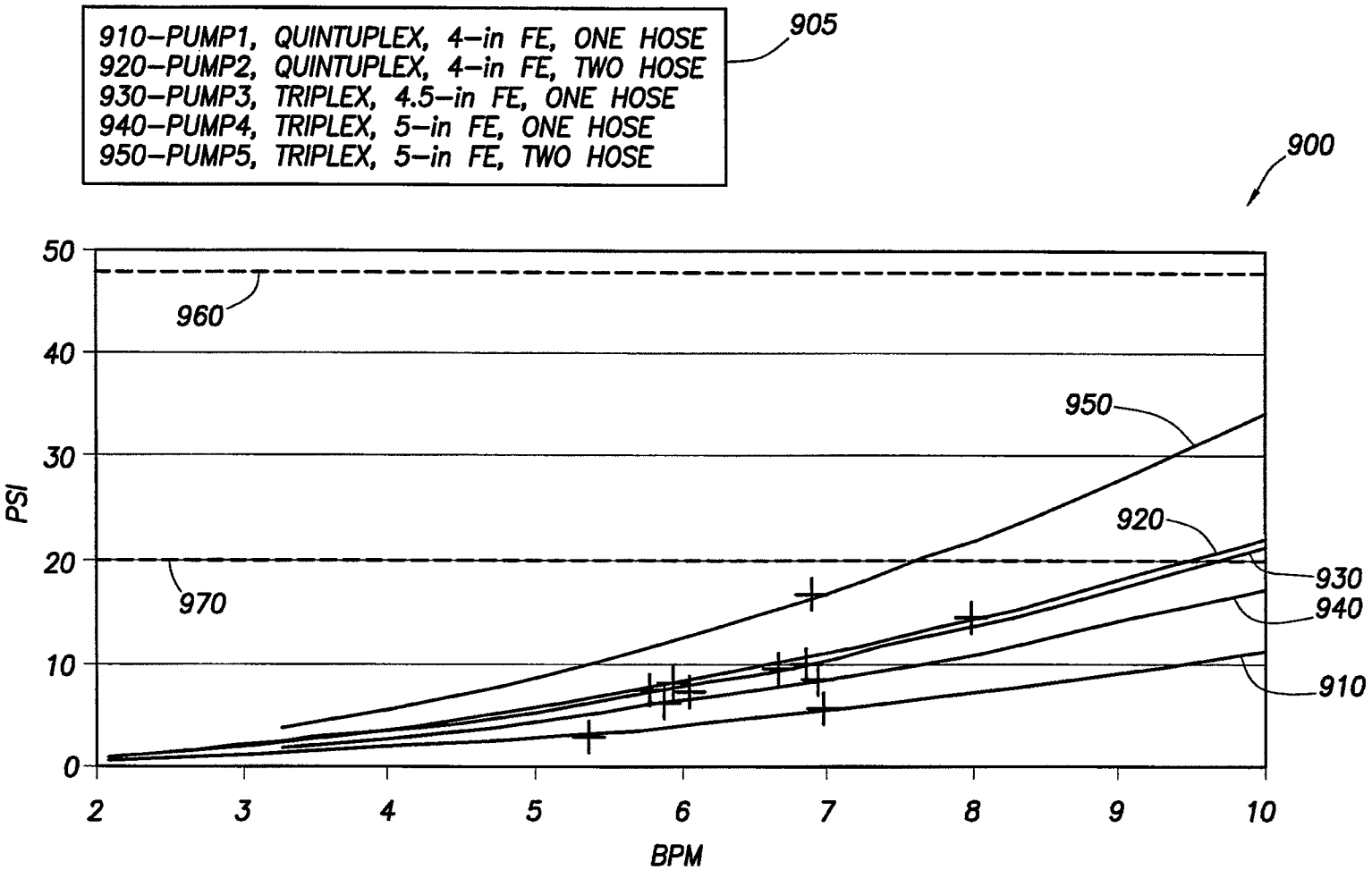
FIG. 9 illustrates a graph of exemplary data for one example pumping system in accordance with certain embodiments of the present disclosure.
Figure 10A:
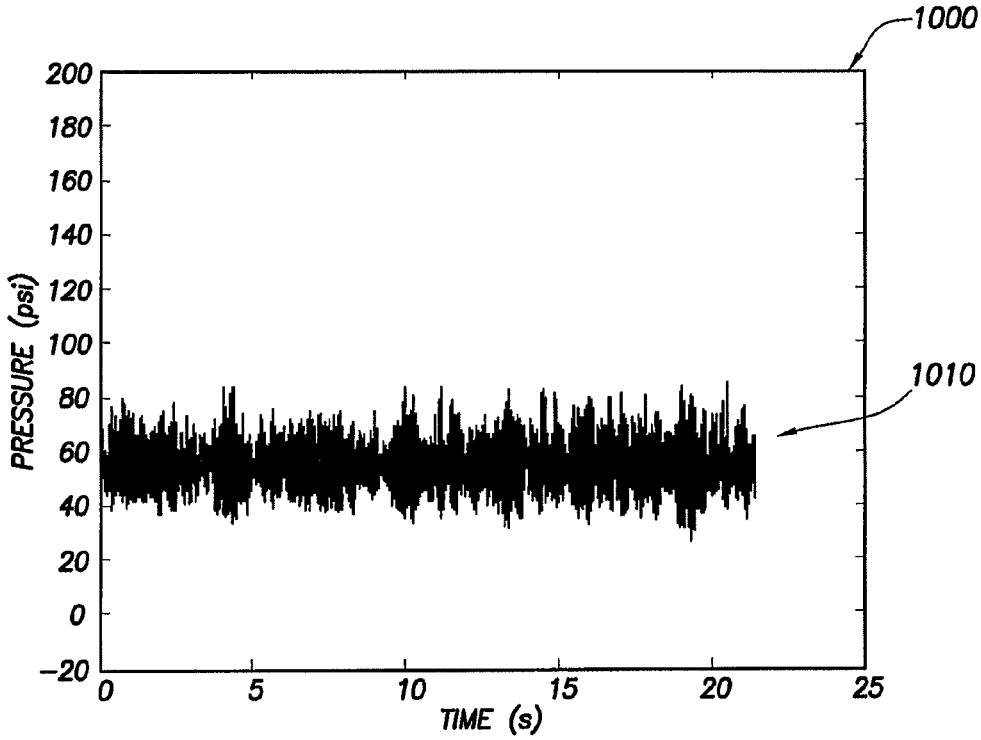
FIGS. 10A, 10B, 10C and 10D illustrate graphs of exemplary data for one example pumping system in accordance with certain embodiments of the present disclosure.
Figure 10B:
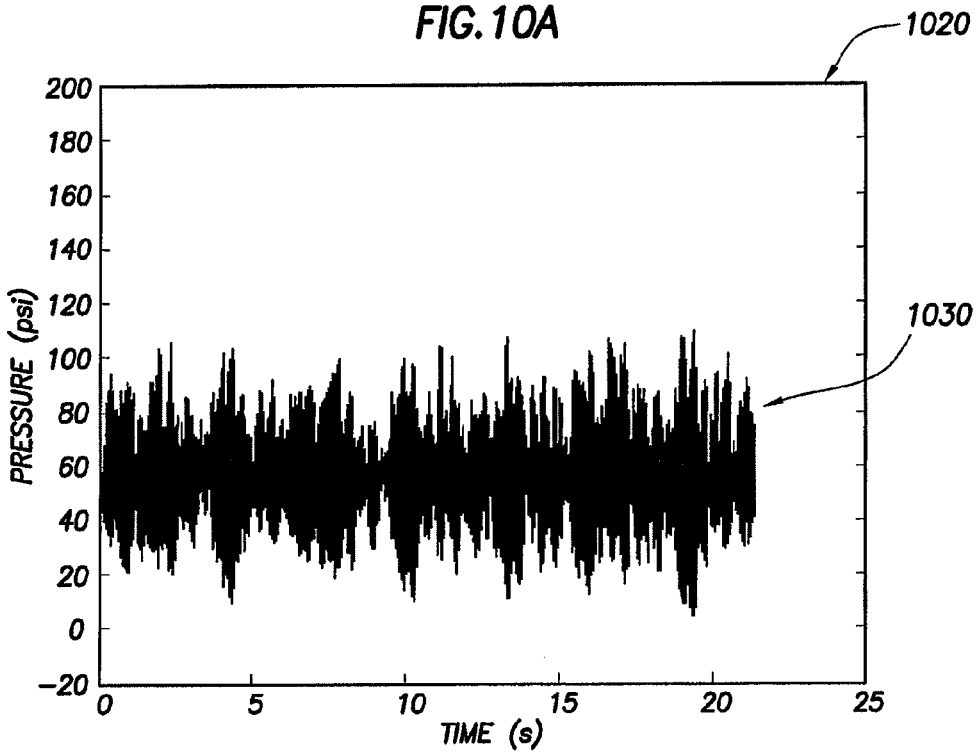
Figure 10C:
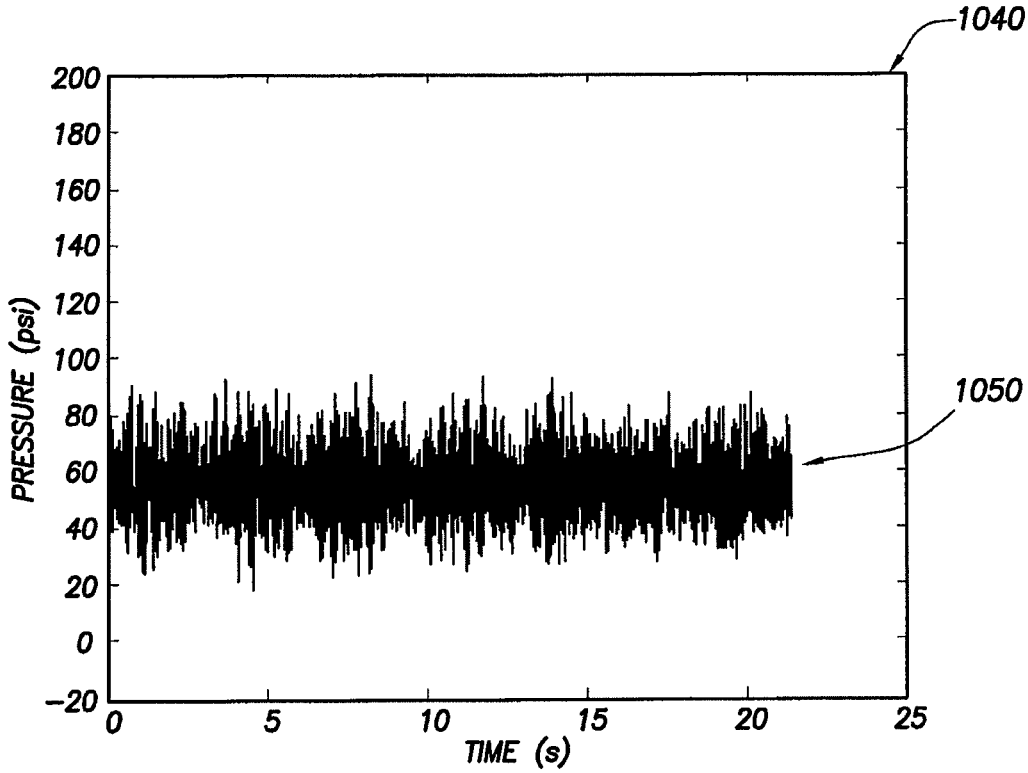
Figure 10D:
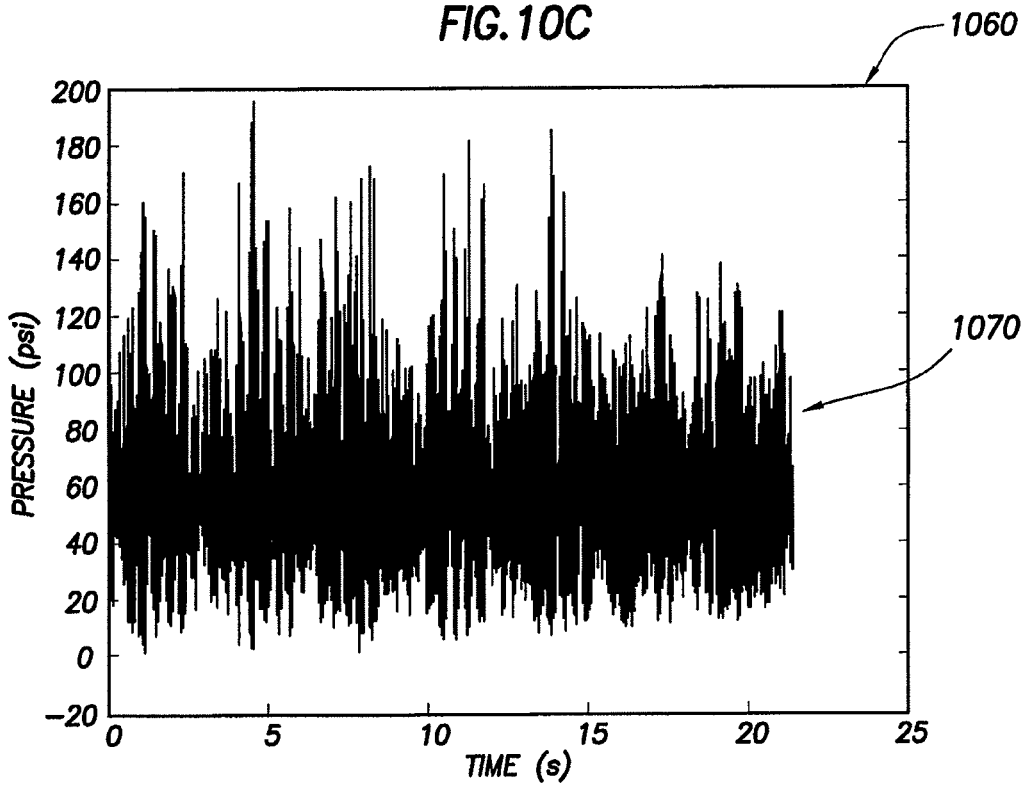

FIGS. 9 through 12 illustrate examples of balancing pumping units in a pumping system in accordance with certain embodiments of the present disclosure. Turning to FIG. 9, graph 900 represents exemplary data for pump suction pressure in suction lines plotted against pump rates of five pumping unit configurations in a pumping system operating at 72 bpm and 9800 psi. Each mark on a pumping unit configuration represents one pump. Therefore, for this system, there are 11 total pumps providing the 72 bpm rate. For a typical well operation, the pressure is a function of the pump rate. The pump rate is varied by varying the engine rpm and the transmission gear. As one pump is decreased in rate so that it has less inertia pressure drop, another pump must be increased in rate so that the net flowrate into the well does not change. The vertical axis represents inertia pressure loss of the fluid in psi and indicates suction pressure loss across a suction line. The horizontal axis represents pump rates in bpm. Element 905 is the legend for the graphical depictions. Each of curves 910-950 may correspond to a suction pressure loss profile for a pumping unit in a pumping system similar to pumping system 200. Curve 910 may correspond to a 4-inch fluid end (FE) quintuplex pumping unit with a single 10 ft hose configuration. Curve 920 may correspond to a 4-inch FE quintuplex pumping unit with a two 10 ft hoses in series configuration. Curve 930 may correspond to a 4.5-inch FE triplex pumping unit connected with a single 10 ft hose configuration. Curve 940 may correspond to a 5-inch FE triplex pumping unit connected with a single 10 ft hose configuration. Curve 950 may correspond to a 5-inch FE triplex pumping unit connected with a two 10 ft hoses in series configuration.

The exemplary data illustrated in graph 900 may correspond to five pumping unit configurations in a pumping system similar to pumping system 200 prior to balancing. Pressure 960 denotes a pressure at a blending unit outlet similar to blending unit outlet 230. Pressure 970 denotes a pressure at a manifold outlet similar to manifold outlet 215. Along each of curves 910-950 are one or more points indicating an operating point for a particular pumping unit. Each of the curves 910 to 950 represents a pumping unit configuration. For instance, curve 910 represents the inertia pressure loss to be expected when operating a 4-inch quintuplex pump with a single 10 ft hose connecting the pump to the manifold trailer 220. There are two pumps with configuration, so there are two marks on curve 910 to represent the two pumps that have the configuration shown by curve 910.

FIGS. 10A-10D respectively show a graphs 1000, 1020, 1040 and 1060 of exemplary data corresponding to the pumping system and pump operating points represented in FIG. 9. The vertical axes of each graph represent inertia pressure of the fluid in psi; the horizontal axes represent time in seconds. Pressure data 1010 illustrates pressure readings over time for a first manifold outlet positioned nearest to a blending unit similar to manifold outlet 215*d*. Pressure data 1030 illustrates pressure readings for a corresponding first pump header inlet similar to pump header inlet 210*d*. Pressure data 1050 illustrates pressure readings for a last manifold outlet positioned furthest from a blending unit similar to manifold outlet 215*c*. Pressure data 1070 illustrates pressure readings for a corresponding last pump header inlet similar to pump header inlet 210*c*.

Figure 11:
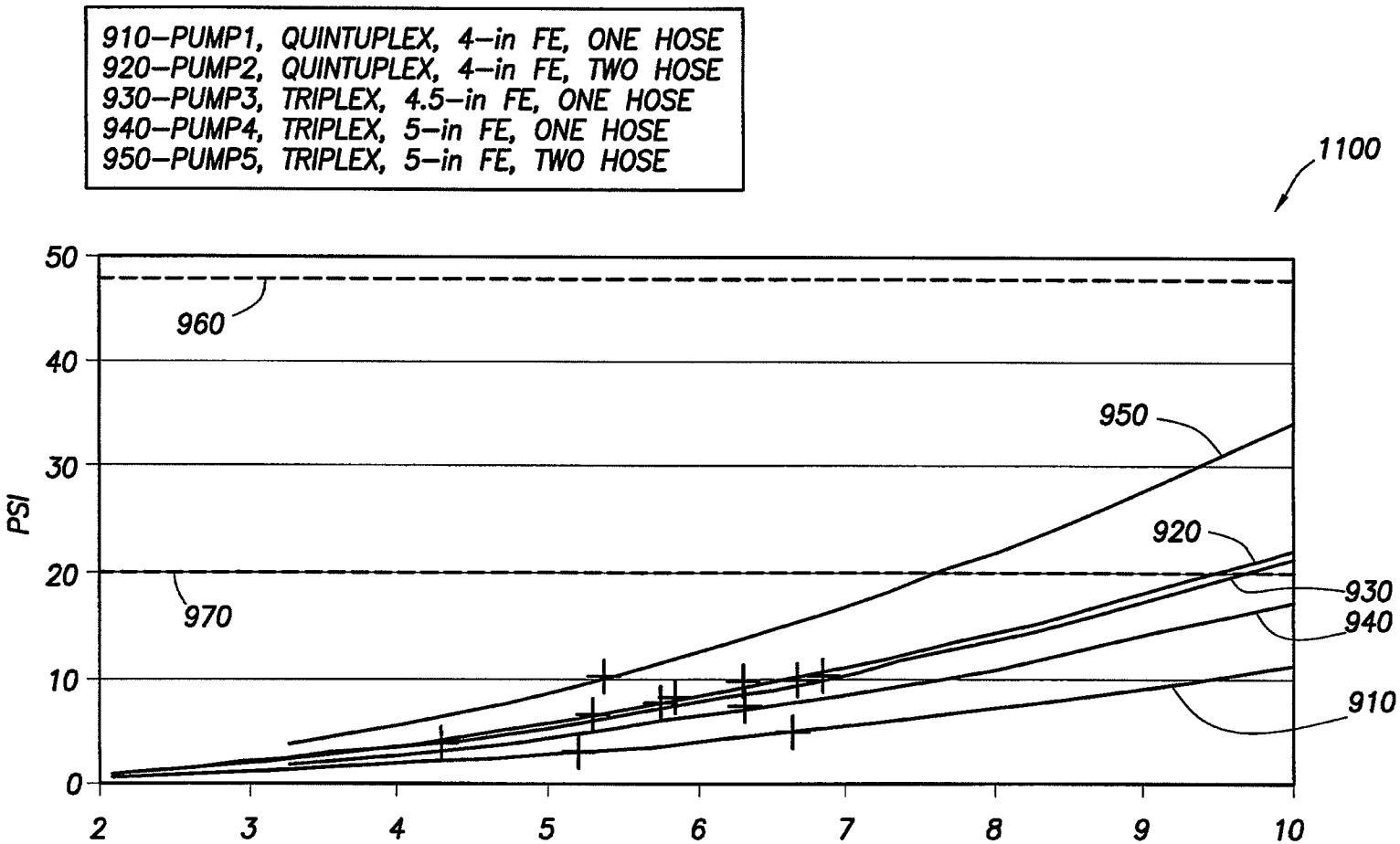
FIG. 11 illustrates a graph of exemplary data for one example pumping system in accordance with certain embodiments of the present disclosure.
Figure 12A:
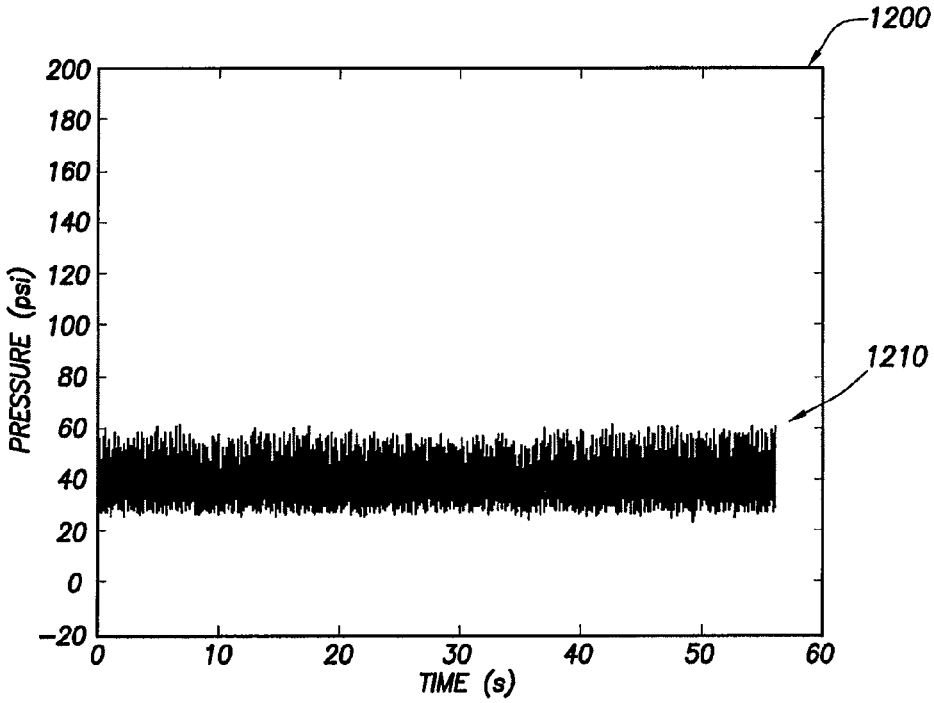
FIGS. 12A, 12B, 12C and 12D illustrate graphs of exemplary data for one example pumping system in accordance with certain embodiments of the present disclosure.
Figure 12B:
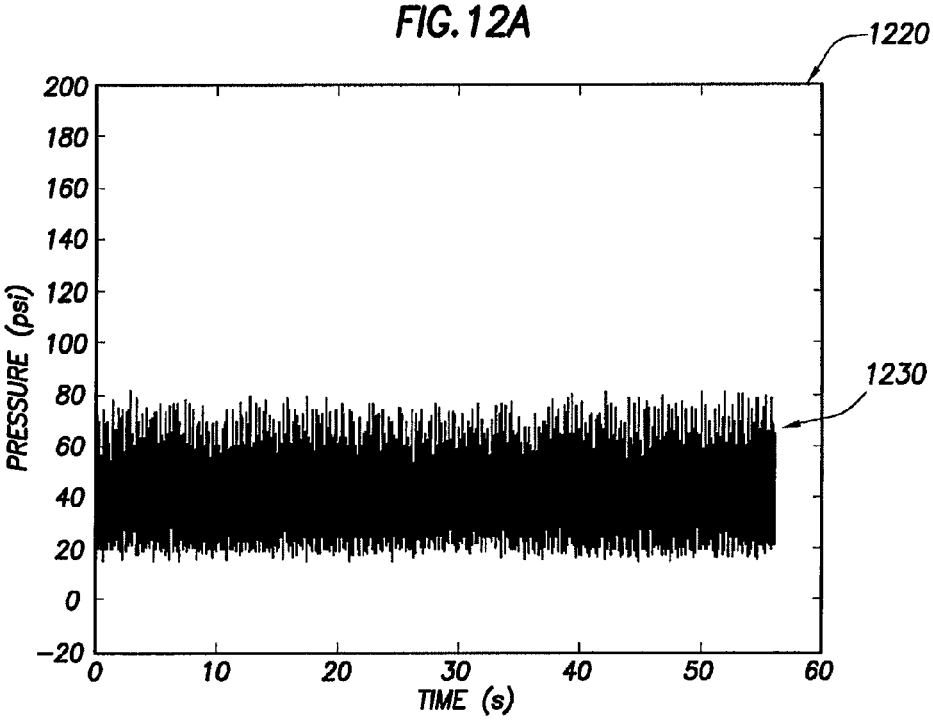
Figure 12C:
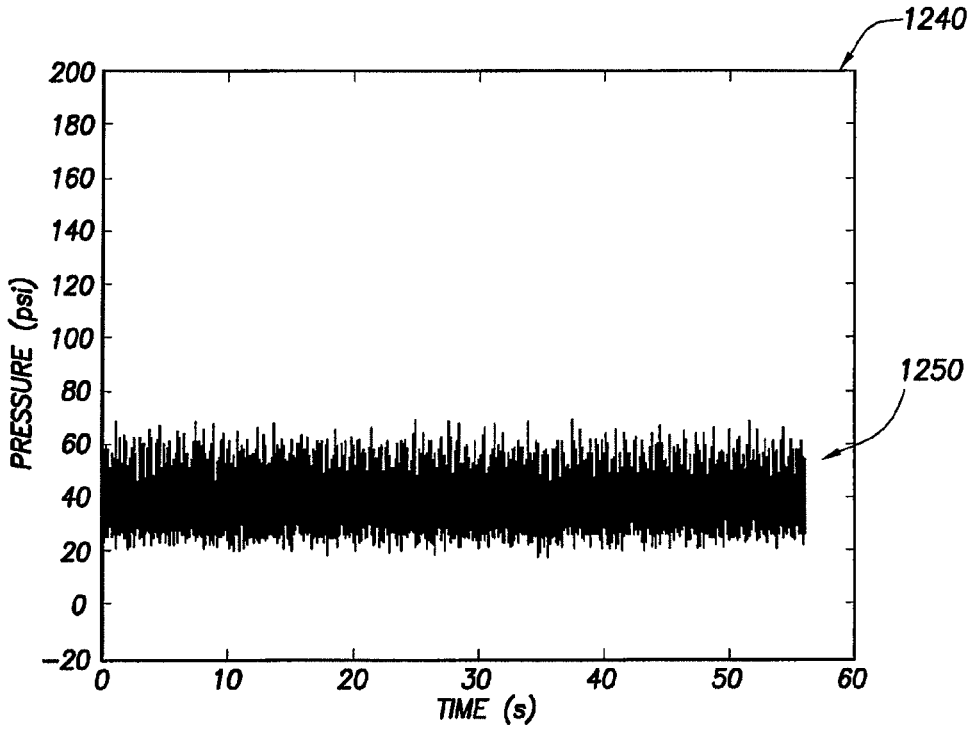
Figure 12D:
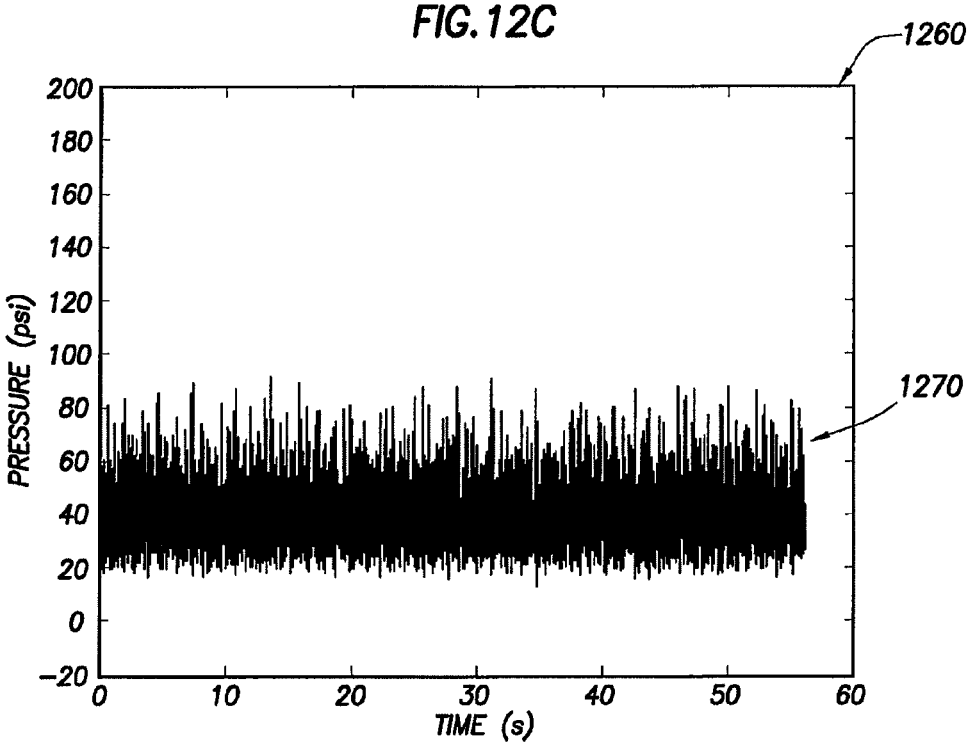

Turning to FIG. 11, graph 1100 represents exemplary data that may correspond to the five pumping unit configurations of the pumping system represented by FIG. 9, except with operating points after balancing according to certain embodiments of this disclosure. The pumping system represented in FIG. 11 may be operating at 72 bpm and 9800 psi. Each mark on a pumping unit configuration represents one pump. Therefore, for this system, there are 11 total pumps providing the 72 bpm rate. For a typical well operation, the pressure is a function of the pump rate. The pump rate is varied by varying the engine rpm and the transmission gear. As one pump is decreased in rate so that it has less inertia pressure drop, another pump must be increased in rate so that the net flowrate into the well does not change. In Figure i Along each of curves 910-950 are one or more points indicating an operating point for a particular pumping unit after the system has been adjusted toward a more balanced state. As compared with FIG. 9, the pumps generally have lower operating points in FIG. 11.

FIGS. 12A-12D respectively show a graphs 1200, 1220, 1240 and 1260 of exemplary data. FIGS. 12A-12D correspond to the pumping system and pump operating points represented in FIG. 11, but otherwise refer to the same locations in the system as FIGS. 10A-10D, respectively. Pressure data 1210 illustrates pressure readings for the first manifold outlet positioned nearest to a blending unit. Pressure data 1230 illustrates pressure readings for a corresponding first pump header inlet across a suction line from the first manifold inlet. Pressure data 1250 illustrates pressure readings for the last manifold outlet positioned furthest from a blending unit. Pressure data 1270 illustrates pressure readings for a corresponding last pump header inlet similar to pump header inlet 210*c*.

As compared with pressure data 1010, 1030, 1050 and 1070, pressure data 1210, 1230, 1250 and 1270 exhibit significantly minimized oscillations. For example, pressure data 1030 shows a mean pressure of approximately 60 psi, with oscillations approaching zero on some lower amplitudes. Pressure data 1230, by contrast, shows a mean pressure of approximately 40 psi with minimized oscillations such that peak lower amplitudes do not dip below approximately 15 psi. Likewise, pressure data 1270, with a mean around 40 psi and peak lower amplitudes approaching 15 psi, shows substantially minimized oscillations as compared to pressure data 1070, which exhibits a mean around 60 psi and peak lower amplitudes approaching zero. Accordingly, the mean boost pressure required to prevent cavitation is minimized, while the risk of cavitation is also minimized.

Thus, in accordance with certain embodiments of the present disclosure, suction characteristics of multiplex pumps may be improved, and the possibility of cavitation in those pumps may be reduced. Oscillations in pressure may be minimized, thereby reducing the mean boost pressure required to prevent cavitation. Boost requirements of pumps in a pumping system may be balanced regardless of the number of plungers, stroke length, size of plungers, suction hose configuration and/or speed of pumps. With the benefit of this disclosure, pump life may be increased, and operation costs may be reduced.

Certain embodiments of this disclosure may be employed prior to operation, for example, as a planning tool to optimize pumping system plans. Certain embodiments may be employed during operation, for example, to identify one or more pumps for speed increase and/or speed reduction. Certain embodiments may utilize an information handling system, for example, to automatically balance pumps in a pumping system. An information handling system may be employed to automatically adjust one or more pumps in a pumping system to reduce cavitation and/or maintain speed based on balancing boost requirements.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A method of specifying one or more operational parameters for a pumping system, the method comprising:

determining a first suction pressure loss profile for a first pump in a pumping system, wherein the first suction pressure loss profile shows a relationship between a pump suction pressure in a suction line of the first pump and a pump rate of the first pump;

determining a second suction pressure loss profile for a second pump in the pumping system, wherein the second suction pressure loss profile shows a relationship between a pump suction pressure in a suction line of the second pump and a pump rate of the second pump;

comparing the first suction pressure loss profile with the second suction pressure loss profile; and specifying one or more operational parameters to modify the operation of the pumping system based, at least in part, on the comparison; and controlling one or more of the first pump and the second pump based, at least in part, on the one or more operational parameters.

2. The method of claim 1, further comprising:

determining an first operating point of the first pump along the first suction pressure loss profile;

determining a second operating point of the second pump along the second suction pressure loss profile; and comparing the first operating point with the second operating point.

3. The method of claim 2 wherein the specifying one or more operational parameters is further based, at least in part, on the comparison of the first operating point and the second operating point.

4. The method of claim 1, wherein the first suction pressure loss profile is based, at least in part, on two or more measurements of pressure associated with the suction line of the first pump, and wherein the second suction pressure loss profile is based, at least in part, on two or more measurements of pressure associated with the suction line of the second pump.

5. The method of claim 1, further comprising:

monitoring one or more of a pressure and a flow rate associated with a suction line of the first pump in real-time; and monitoring one or more of a pressure and a flow rate associated with a suction line of the second pump in real-time.

6. The method of claim 1 wherein at least one of the first pump and the second pump is selected from a group consisting of a positive displacement pump, a plunger pump, a triplex pump, and a quintuplex pump.

7. A computer program stored in a non-transitory computer readable storage medium specifying one or more operational parameters for a pumping system, comprising executable instructions to cause at least one processor to:

determine a first suction pressure loss profile for a first pump in a pumping system, wherein the first suction pressure loss profile shows a relationship between a pump suction pressure in a suction line of the first pump and a pump rate of the first pump;

determine a second suction pressure loss profile for a second pump in the pumping system, wherein the second suction pressure loss profile shows a relationship between a pump suction pressure in a suction line of the second pump and a pump rate of the second pump;

compare the first suction pressure loss profile with the second suction pressure loss profile; and specify one or more operational parameters to modify the operation of the pumping system based, at least in part, on the comparison.

8. The computer program of claim 7, further comprising executable instructions to cause the at least one processor to:

determine a first operating point of the first pump along the first suction pressure loss profile;

determine a second operating point of the second pump along the second suction pressure loss profile; and compare the first operating point with the second operating point.

9. The computer program of claim 8, wherein the specifying one or more operational parameters is further based, at least in part, on the comparison of the first operating point and the second operating point.

10. The computer program of claim 9, further comprising executable instructions to cause the at least one processor to:

control one or more of the first pump and the second pump based, at least in part, on the one or more operational parameters.

11. The computer program of claim 7, wherein the first suction pressure loss profile is based, at least in part, on two or more measurements of pressure associated with the suction line of the first pump, and wherein the second suction pressure loss profile is based, at least in part, on two or more measurements of pressure associated with the suction line of the second pump.

12. The computer program of claim 7, further comprising executable instructions to cause the at least one processor to:

monitor one or more of a pressure and a flow rate associated with a suction line of the first pump in real-time; and monitor one or more of a pressure and a flow rate associated with a suction line of the second pump in real-time.

13. The computer program of claim 7, wherein at least one of the first pump and the second pump is selected from a group consisting of a positive displacement pump, a plunger pump, a triplex pump, and a quintuplex pump.

14. An information handling system, comprising:

a processor communicatively coupled to a memory; and a computer readable medium comprising instructions that cause at least one processor to:

determine a first suction pressure loss profile for a first pump in a pumping system, wherein the first suction pressure loss profile shows a relationship between a pump suction pressure in a suction line of the first pump and a pump rate of the first pump;

determine a second suction pressure loss profile for a second pump in the pumping system, wherein the second suction pressure loss profile shows a relationship between a pump suction pressure in a suction line of the second pump and a pump rate of the second pump;

compare the first suction pressure loss profile with the second suction pressure loss profile; and specify one or more operational parameters to modify the operation of the pumping system based, at least in part, on the comparison.

15. The information handling system of claim 14, where the instructions further cause the at least one processor to:

determine a first operating point of the first pump along the first suction pressure loss profile;

determine a second operating point of the second pump along the second suction pressure loss profile; and compare the first operating point with the second operating point.

16. The information handling system of claim 15, wherein the specifying one or more operational parameters is further based, at least in part, on the comparison of the first operating point and the second operating point.

17. The information handling system of claim 15, where the instructions further cause the at least one processor to:

control one or more of the first pump and the second pump based, at least in part, on the one or more operational parameters.

18. The information handling system of claim 14, where the instructions further cause the at least one processor to:

monitor one or more of a pressure and a flow rate associated with a suction line of the first pump in real-time; and monitor one or more of a pressure and a flow rate associated with a suction line of the second pump in real-time.

19. The information handling system of claim 15, wherein at least one of the first pump and the second pump is selected from a group consisting of a positive displacement pump, a plunger pump, a triplex pump, and a quintuplex pump.

* * * * *